US008057250B2

(12) United States Patent
Lim

(10) Patent No.: US 8,057,250 B2
(45) Date of Patent: Nov. 15, 2011

(54) CABLE ORGANIZER FOR ELECTRICAL CONNECTOR

(75) Inventor: Chin Hua Lim, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/748,721

(22) Filed: Mar. 29, 2010

(65) Prior Publication Data

US 2011/0237117 A1 Sep. 29, 2011

(51) Int. Cl.
*H01R 13/58* (2006.01)

(52) U.S. Cl. ..... 439/470

(58) Field of Classification Search ..... 439/460–473
See application file for complete search history.

(56) References Cited

U.S. PATENT DOCUMENTS 4,280,746 A 7/1981 Ignatowicz
4,640,569 A 2/1987 Dola et al.
5,183,411 A 2/1993 Yu
5,391,092 A * 2/1995 Sumida ..... 439/470
5,755,597 A 5/1998 Panis et al.
6,196,865 B1 3/2001 Ruffel et al.
6,478,609 B1 11/2002 Davis et al.
6,878,009 B2 4/2005 Amemiya
6,962,504 B2 * 11/2005 Fukui et al. ..... 439/466
7,371,106 B2 5/2008 Nad

* cited by examiner

*Primary Examiner* — Ross Gushi
(74) *Attorney, Agent, or Firm* — Johannes P. M. Kusters

(57) ABSTRACT

A cable organizer for use with an electrical connector terminated to an electrical cable includes a monolithic insulative housing including a base portion and a cover portion hingedly secured to and extending from the base portion. The base portion includes a bottom wall and opposing first side walls extending from the bottom wall. The cover portion includes a top wall and opposing second side walls extending from the top wall. The bottom wall, top wall, and first side walls cooperatively define a channel configured to retain the electrical cable when the cable organizer is assembled to the terminated electrical connector. The cable organizer may include a spring clip disposed in the channel and configured to assist in retaining the electrical cable.

12 Claims, 10 Drawing Sheets

CABLE ORGANIZER FOR ELECTRICAL CONNECTOR

TECHNICAL FIELD

The present disclosure relates generally to terminations made between an electrical connector and an electrical cable. More particularly, the present disclosure relates to a cable organizer for properly managing these terminations.

BACKGROUND

It is well known in the art to use a cable organizer for electrical connectors terminated to wires or a cable to minimize stress on the cable and terminated wires. A typical conventional cable organizer may include two separate members that are securable around the connector housing and wires. The two separate members may be secured together by a variety of methods, such as, e.g., external hardware of interlocking features on the two members. Another typical conventional cable organizer may include a protective sleeve provided around the connector housing and wires. Although conventional cable organizers may adequately minimize stress on the cable and terminated wires, they are often costly, bulky and complex in design, difficult to assemble to and/or remove from an electrical connector terminated to wires or a cable, and suitable only for use with a particular wire or cable size. In addition, conventional cable organizers are not designed to contribute to the electrical grounding of the electrical connector terminated to wires or a cable. What clearly is needed is a cable organizer that provides greater flexibility in its use and that is easy and economical to produce.

SUMMARY

In one aspect, the present invention provides a cable organizer for use with an electrical connector terminated to an electrical cable. The cable organizer comprises a monolithic insulative housing including a base portion and a cover portion hingedly secured to and extending from the base portion. The base portion includes a bottom wall and opposing first side walls extending from the bottom wall. The cover portion includes a top wall and opposing second side walls extending from the top wall. The bottom wall, top wall, and first side walls cooperatively define a channel configured to retain the electrical cable when the cable organizer is assembled to the terminated electrical connector. The cable organizer may include a spring clip disposed in the channel and configured to assist in retaining the electrical cable.

In another aspect, the present invention provides an electrical connector assembly comprising an electrical connector terminated to an electrical cable having a plurality of conductors and a cable organizer assembled to the terminated electrical connector. The cable organizer comprises a monolithic insulative housing including a base portion and a cover portion hingedly secured to and extending from the base portion. The base portion includes a bottom wall and opposing first side walls extending from the bottom wall. The cover portion includes a top wall and opposing second side walls extending from the top wall. The bottom wall, top wall, and first side walls cooperatively define a channel configured to retain the electrical cable.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1A:
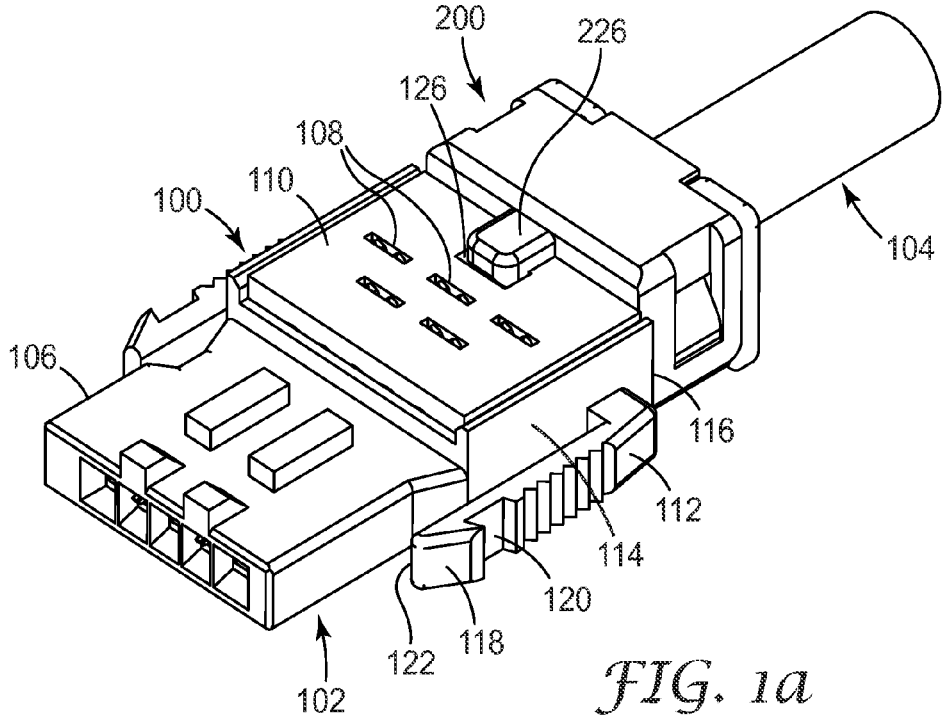
FIG. 1*a* is top perspective view of an exemplary embodiment of a terminated electrical connector and cable organizer according to an aspect of the present invention.
Figure 1B:
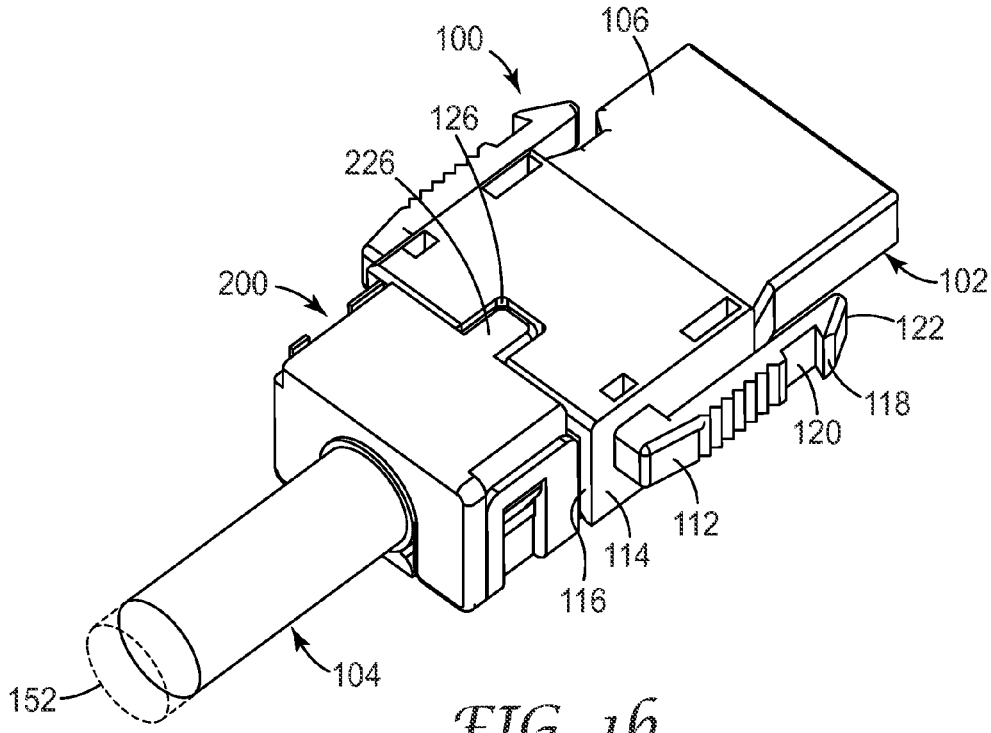
FIG. 1*b* is a bottom perspective view of the terminated electrical connector and cable organizer of FIG. 1*a*.
Figure 4A:
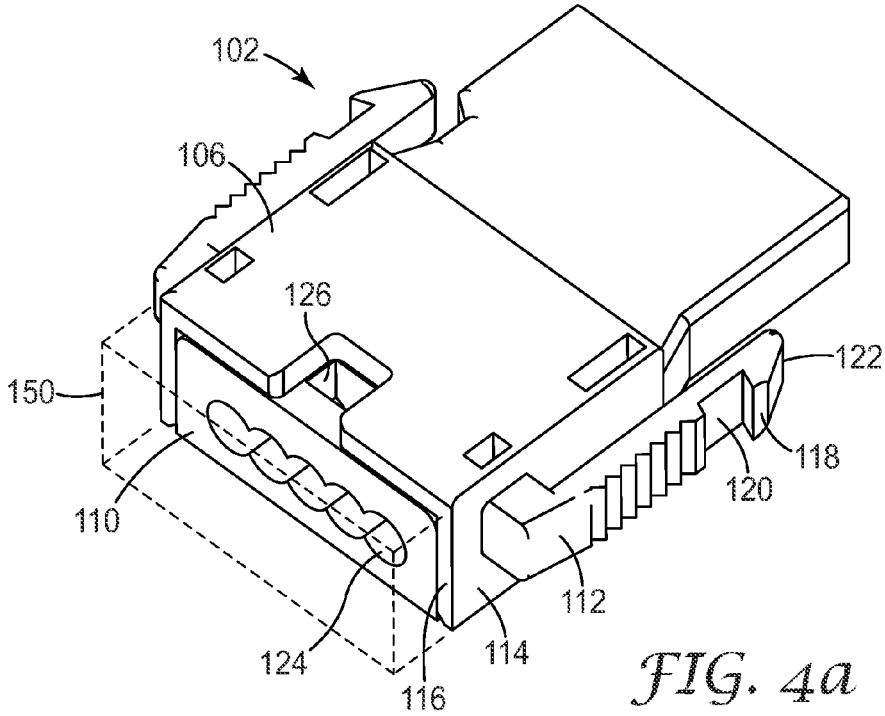
FIG. 4*a* is a bottom perspective view of the electrical connector of FIG. 1*a*.
Figure 4B:
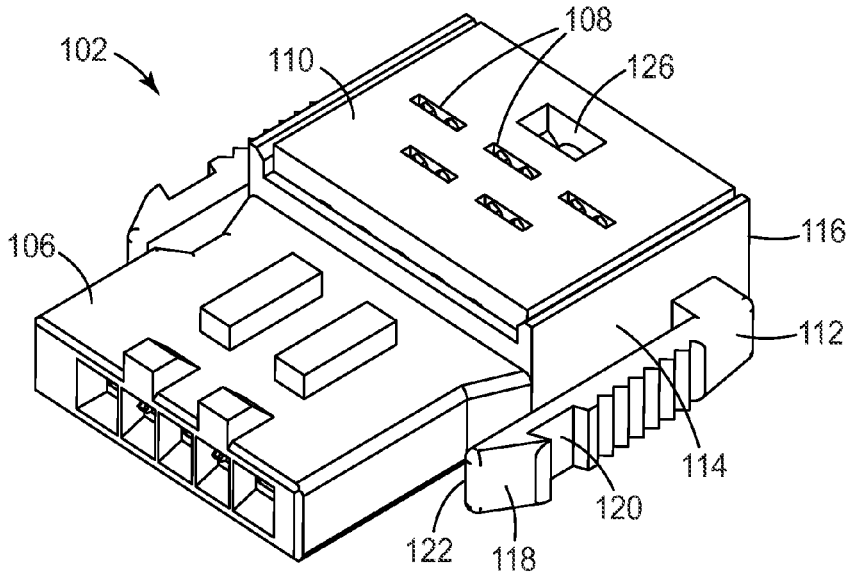
FIG. 4*b* is a top perspective view of the electrical connector of FIG. 1*a*.

Referring now to the Figures, FIGS. 1*a*-1*b* illustrate an exemplary embodiment of a terminated electrical connector 100 and cable organizer 200 according to an aspect of the present invention. Terminated electrical connector 100 includes an electrical connector 102 and an electrical cable 104 terminated to the electrical connector 102. Referring also to FIGS. 4*a*-4*b*, electrical connector 102 includes a body 106, a plurality of terminals 108 disposed in body 106, a conductor mounting part 110, and a latch lever 112. Latch level 112 extends in a mating direction from both side walls 114 near back end 116 of body 106. A locking part 118 that engages with a locking hole of a mating connector (not shown) is provided on outside surface 120 of latch lever 112 at tip end 122. Terminals 108 are electrically connected to corresponding contacts of a mating connector (not shown) when terminated electrical connector 100 is mated to the mating connector, and are mechanically and electrically connected to conductors 128 and ground conductor 134 (shown, e.g., in FIG. 2*a*) of electrical cable 104 that are inserted into conductor holes 124 (shown, e.g., in FIG. 4*a*) of conductor mounting part 110.

Electrical connector 102 and cable organizer 200 include corresponding retention elements 126 and 226, respectively, configured to cooperatively retain cable organizer 200 and electrical connector 102 in a fixed relative position, which, e.g., prevents individual conductors of electrical cable 104, such as, e.g., conductors 128 and ground conductor 134, from bending and twisting. In the embodiment illustrated in FIGS. 1*a*-1*b*, retention elements 226 are configured as a latch and retention elements 126 are configured as a notch configured to receive the latch. Retention elements 226 can best be seen in FIGS. 5*a*-5*c*. Retention elements 126 can best be seen in FIGS. 4*a*-4*b*. An advantage of configuring retention elements 126 as a notch is that it requires minimal modification of body 106 and conductor mounting part 110 and has a minimal impact on the functionality and integrity of body 106 and conductor mounting part 110. In other embodiments, retention elements 126 and 226 may have other configurations as suitable for the intended application.

Figure 2A:
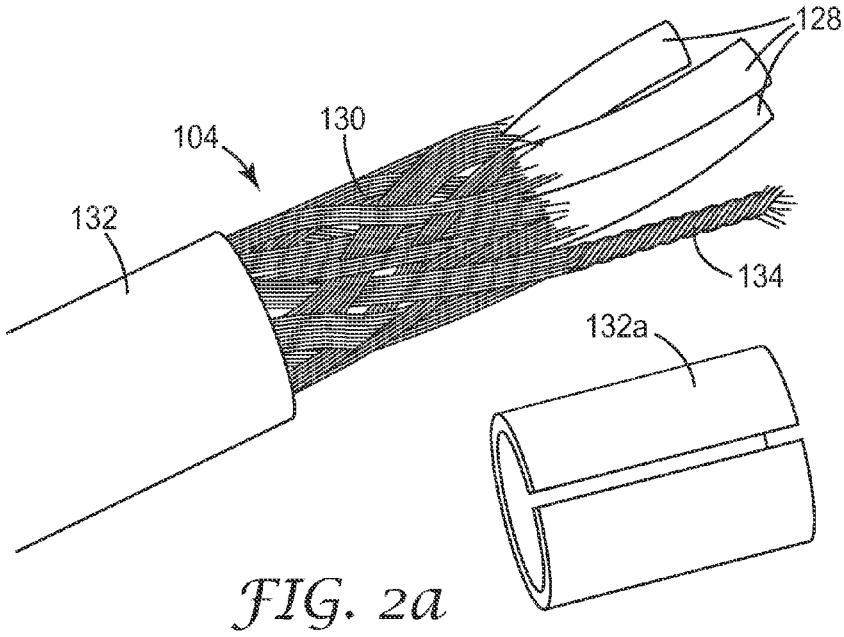
FIGS. 2*a*-2*f* are perspective views illustrating steps of an exemplary process of terminating an exemplary embodiment of an electrical connector and electrical cable according to an aspect of the present invention.
Figure 2B:
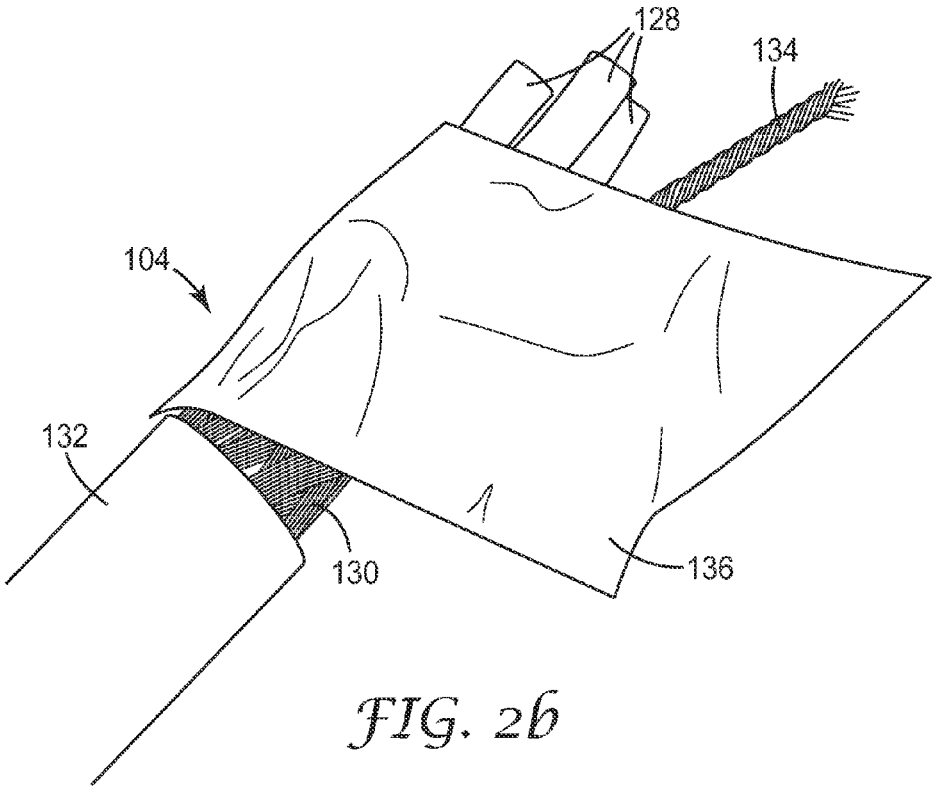
Figure 2C:
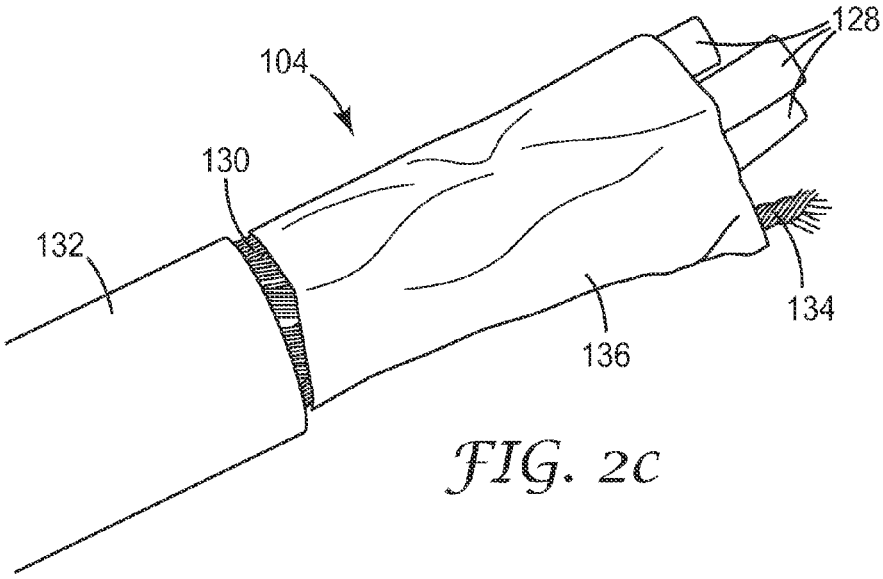
Figure 2D:
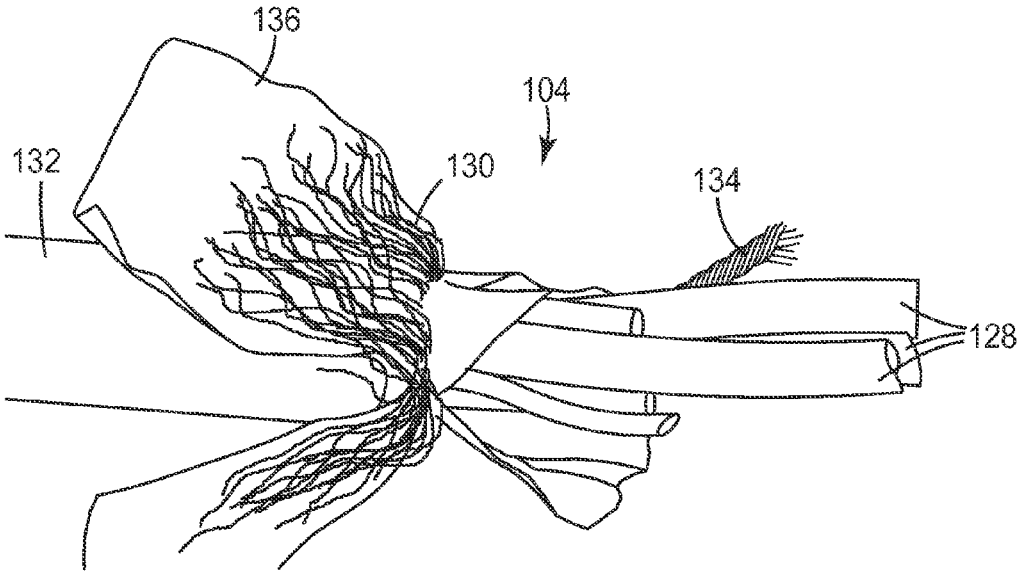

FIGS. 2*a*-2*f* illustrate steps of an exemplary process of terminating electrical connector 102 and electrical cable 104 according to an aspect of the present invention. Referring to FIG. 2*a*, electrical cable 104 includes a plurality of conductors 128, a ground shield 130 disposed around conductors 128, and an insulative jacket 132 disposed around conductors 128 and ground shield 130. In the step illustrated in FIG. 2*a*, a portion 132*a* of insulative jacket 132 is separated and removed from electrical cable 104 exposing a portion of ground shield 130, and a ground conductor 134 is separated from ground shield 130. In the steps illustrated in FIGS. 2*b*-2*c*, a conductive tape 136 is applied around the exposed portion of ground shield 130. In the embodiment illustrated in FIGS. 2*b*-2*c*, conductive tape 136 includes a copper tape. In other embodiments, conductive tape 136 may be omitted or other conductive tapes may be used as suitable for the intended application. In the step illustrated in FIG. 2*d*, conductive tape 136 and ground shield 130 (adhered to conductive tape 136) are folded backward (towards insulative jacket 132), exposing end portions of conductors 128 and ground conductor 134. In the step illustrated in FIG. 2*e*, a portion of conductive tape 136 is folded forward, sandwiching ground shield 130 and covering an end portion of insulative jacket 132. In particular when ground shield 130 is a braided shield that includes a plurality of individual braid wires, sandwiching the individual braid wires prevents them from potentially causing an electrical short. This completes the preparation of electrical cable 104 for assembly to electrical connector 102. This cable preparation method in conjunction with the use of cable organizer 200 eliminates the need for shrink tubing, which is often used in conventional cable preparation methods to minimize stress on exposed portions of conductors 128 and ground conductor 134 and insulating ground shield 130 and ground conductor 134. It also enables an electrical connection of ground shield 130 through conductive tape 136. In the step illustrated in FIG. 2*f*, electrical cable 104 is assembled to electrical connector 102. In one exemplary method, conductor mounting part 110 is in an open position (i.e., raised and parallel or angled with respect to body 106). End portions of conductors 128 and ground conductor 134 are inserted into conductor holes 124 of conductor mounting part 110. Then, pressure is applied to conductor mounting part 110 to move conductor mounting part 110 in a closed position (i.e., seated in body 106), thereby establishing an electrical and mechanical connection of conductors 128 and ground conductor 134 with corresponding terminals 108. In one embodiment, terminals 108 may be insulation displacement contact (IDC) terminals.

Figure 3A:
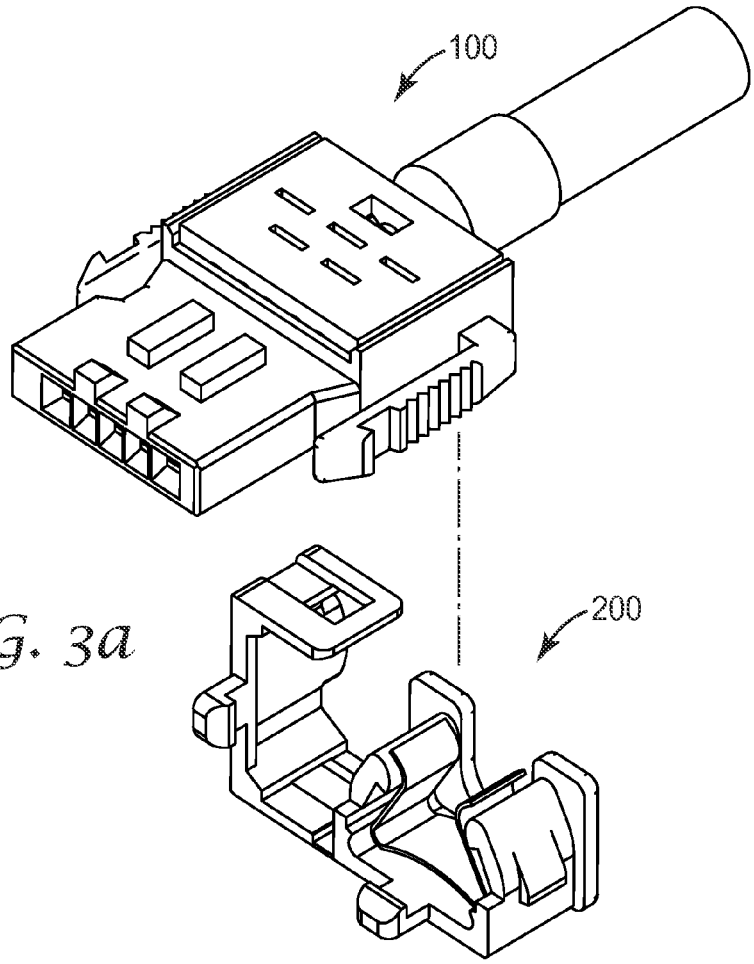
FIG. 3*a* is a top perspective view of the terminated electrical connector and cable organizer of FIG. 1*a*, wherein the cable organizer is positioned for assembly to the terminated electrical connector and in an open position.
Figure 3B:
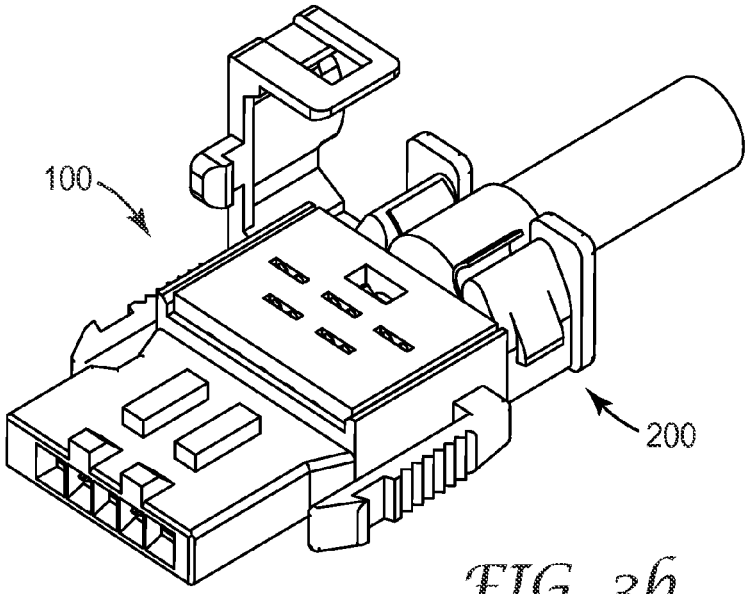
FIG. 3*b* is a top perspective view of the terminated electrical connector and cable organizer of FIG. 1*a*, wherein the cable organizer is assembled to the terminated electrical connector and in an open position.
Figure 3C:
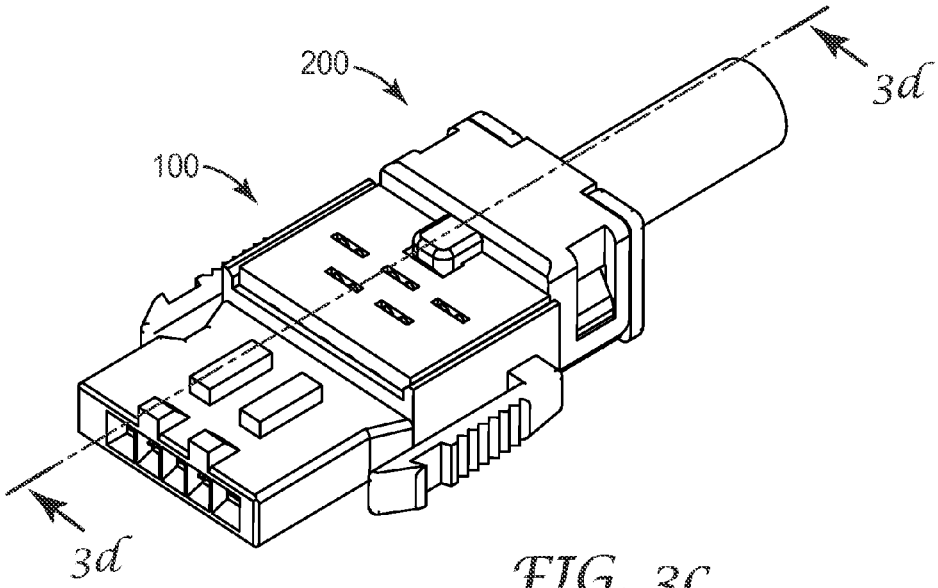
FIG. 3*c* is a top perspective view of the terminated electrical connector and cable organizer of FIG. 1*a*, wherein the cable organizer is assembled to the terminated electrical connector and in a closed position.
Figure 3D:
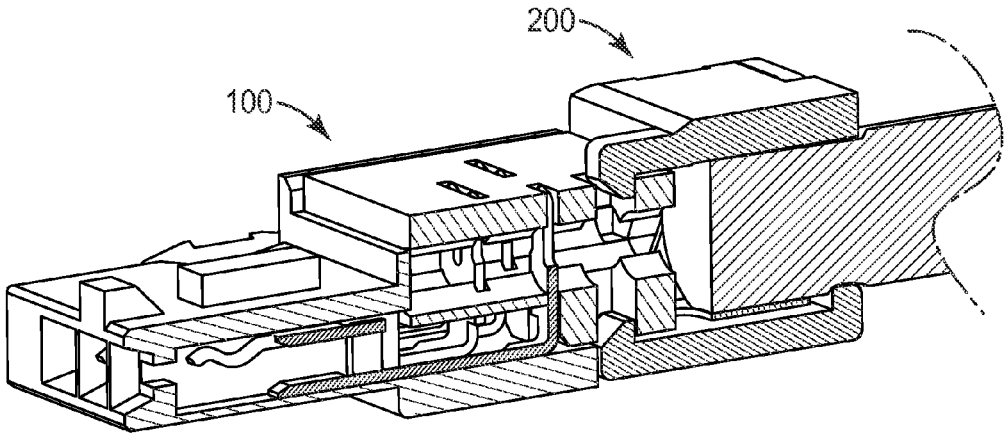
FIG. 3*d* is a cross-sectional perspective view of the terminated electrical connector and cable organizer of FIG. 1*a* taken along line 3*d*-3*d* of FIG. 3*c*.

FIGS. 3*a*-3*b* illustrate the assembly of cable organizer 200 and terminated electrical connector 100. In FIG. 3*a*, cable organizer 200 is positioned for assembly to terminated electrical connector 100 and in an open position. In FIG. 3*b*, cable organizer 200 is assembled to terminated electrical connector 100 and in an open position. In FIGS. 3*c*-3*d*, cable organizer 200 is assembled to terminated electrical connector 100 and in a closed position. Cable organizer 200 is configured to retain and provide strain relief to electrical cable 104, provide protection of exposed portions of conductors 128, ground conductor 134, and ground shield 130, e.g., and prevent ground shield 130 of electrical cable 104 from causing an electrical short, in particular when ground shield 130 is a braided shield that includes a plurality of individual braid wires. In addition, it is easily assembled to and removed from terminated electrical connector 100 and reusable.

Figure 5A:
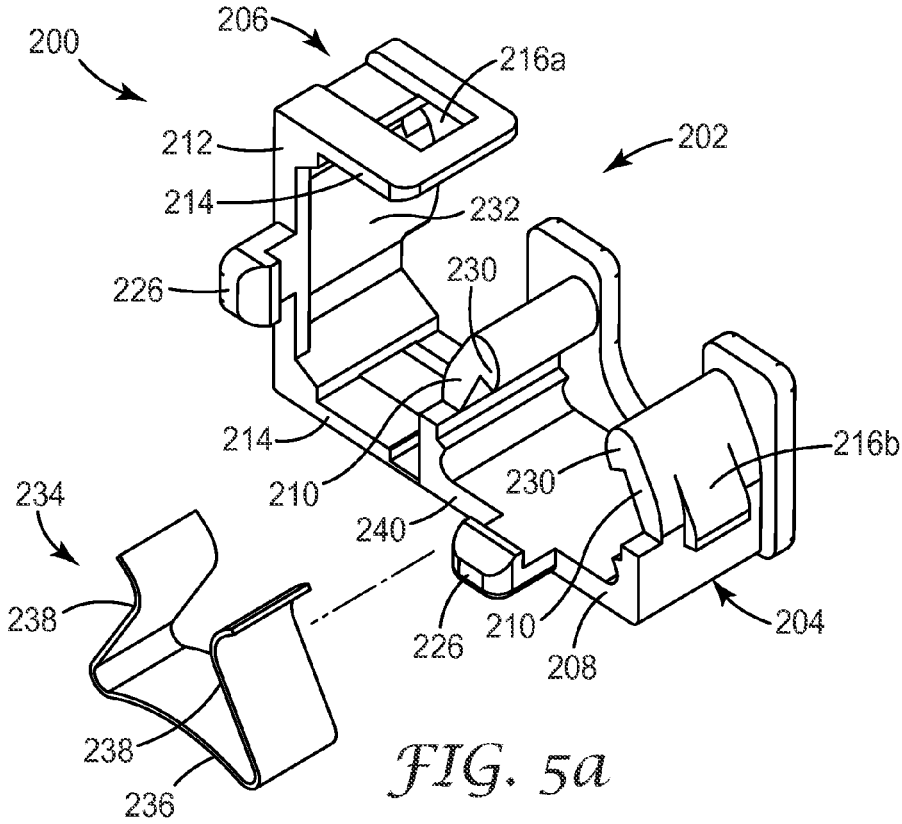
FIG. 5*a* is an exploded top perspective view of the cable organizer of FIG. 1*a* in an open position.
Figure 5B:
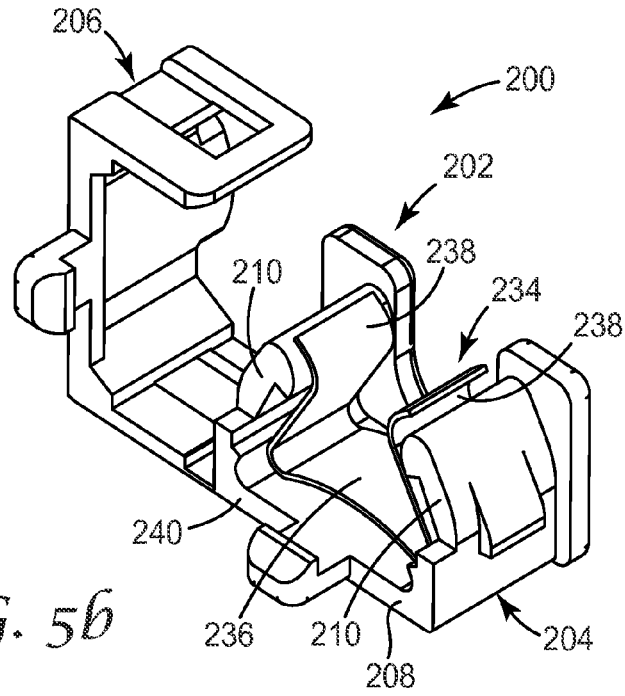
FIG. 5*b* is a top perspective view of the cable organizer of FIG. 1*a* in an open position.
Figure 5C:
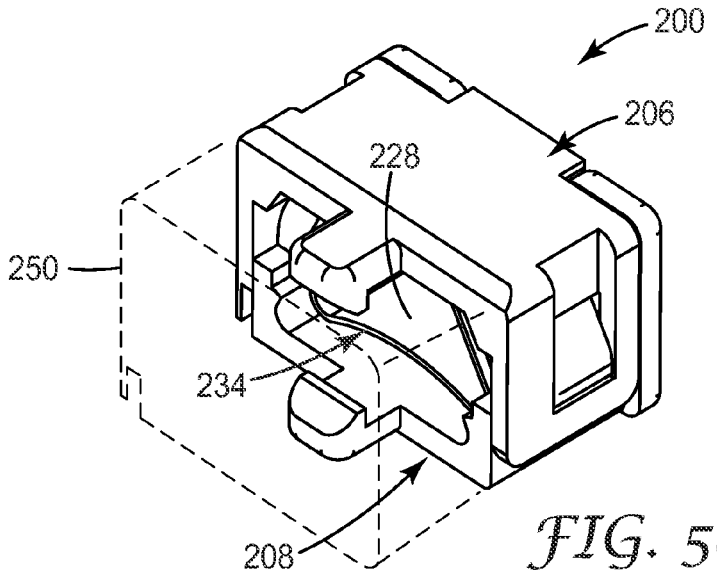
FIG. 5*c* is a top perspective view of the cable organizer of FIG. 1*a* in a closed position.

Referring now to FIGS. 5*a*-5*c*, cable organizer 200 includes a monolithic insulative housing 202 including a base portion 204 and a cover portion 206 hingedly secured to and extending from base portion 204. Base portion 204 includes a bottom wall 208 and opposing first side walls 210 extending from bottom wall 208. Cover portion 206 includes a top wall 212 and opposing second side walls 214 extending from top wall 212. In the embodiment illustrated in FIGS. 5*a*-5*c*, cover portion 206 is hingedly secured to and extends from base portion 204 at one of first and second side walls 210 and 214. The opposing first and second side walls 210 and 214 include corresponding latch members 216*a* and 216*b* configured to cooperatively retain cable organizer 200 in a closed position (FIG. 5*c*). Cable organizer 200 further includes opposing retention elements 226 extending from bottom wall 208 and top wall 212 respectively. As described above, retention elements 226 are configured to retain cable organizer 200 and electrical connector 102 in a fixed relative position. In combination, retention elements 226 and the hinge-and-latch configuration of base portion 204 and cover portion 206 as described above allow cable organizer 200 to be easily assembled to terminated electrical connector 100, simultaneously establishing the retention of electrical cable 104 and the interlocking of cable organizer 200 and electrical connector 102.

Bottom wall 208, top wall 212, and first side walls 210 cooperatively define a channel 228 configured to retain electrical cable 104 when cable organizer 200 is assembled to terminated electrical connector 100. Retaining electrical cable 104 provides strain relief to electrical cable 104, which typically includes providing strain relief to conductors 128 and ground conductor 134. To assist in the retention of electrical cable 104, opposing first side walls 210 each include a first grip element 230 extending into channel 228. During assembly of cable organizer 200 to terminated electrical connector 100, electrical cable 104 may elastically deform as it passes first grip elements 230 to be positioned in channel 228. When electrical cable 104 is positioned in channel 228, first grip elements 230 may provide additional clamping force to electrical cable 104, e.g., at insulative jacket 132, to assist in its retention. Although in the embodiment illustrated in FIGS. 5*a*-5*c* first grip elements 230 include a continuous ridge extending along the length of first side walls 210, in other embodiments, first grip elements 230 may be discontinuous, and may have other shapes as suitable for the intended application. To assist in the retention of electrical cable 104, top wall 212 includes a second grip element 232 extending into channel 228. When cable organizer 200 is assembled to terminated electrical connector 100 and in a closed position (FIG. 5*c*), second grip element 232 may provide additional clamping force to electrical cable 104, thereby assisting in its retention. Although in the embodiment illustrated in FIGS. 5*a*-5*c* second grip element 232 includes a curved protrusion extending from top wall 212, in other embodiments, second grip element 232 may have other shapes as suitable for the intended application. The size and shape of channel 228, first grip elements 230, and second grip element 232 may be selected based on the size and shape of electrical cable 104 and the appropriate retention force as suitable for the intended application.

Figure 2E:
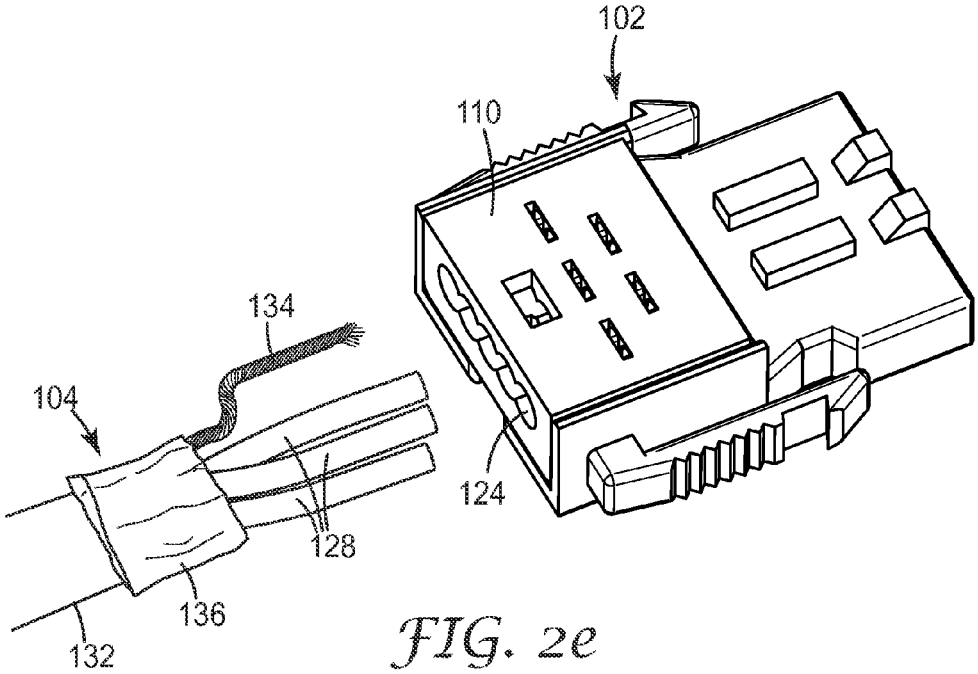
Figure 2F:
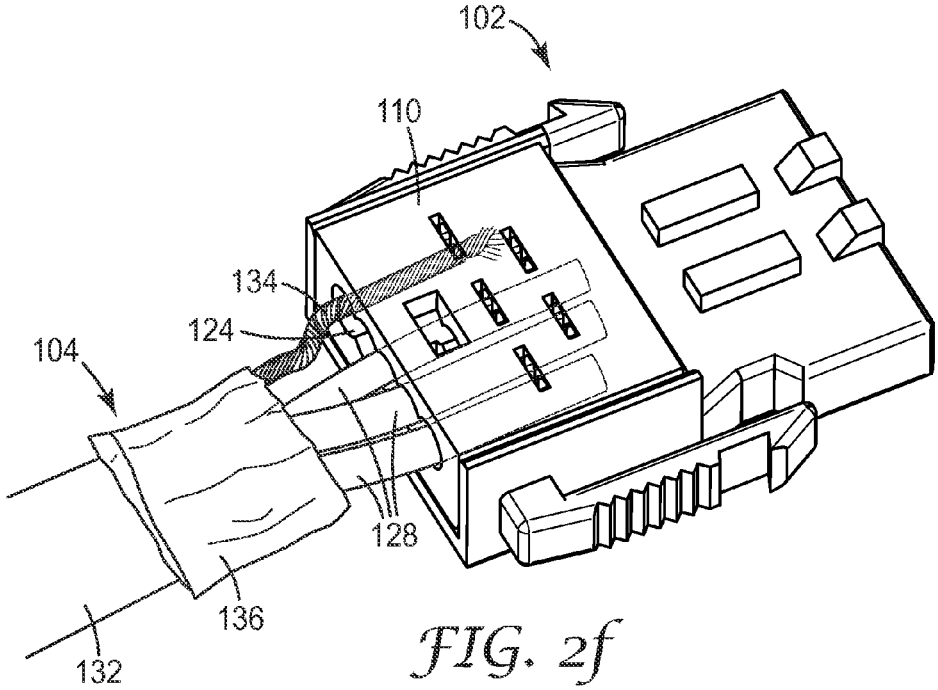

In the embodiment illustrated in FIGS. 5*a*-5*c*, cable organizer 200 optionally includes a spring clip 234 disposed in channel 228 and configured to assist in retaining electrical cable 104. Spring clip 234 includes a bottom portion 236 and opposing side portions 238 extending from bottom portion 236. Bottom portion 236 is shaped to correspond to bottom wall 208 of base portion 204 and opposing side portions 238 are shaped to correspond to opposing side walls 210 of base portion 204 such that it can resiliently deflect to receive electrical cable 104. In the embodiment illustrated in FIGS. 5*a*-5*c*, spring clip 234 has a substantially triangular shape, wherein bottom portion 236 and opposing side portions 238 are curved inward. This configuration provides three points of contact cooperatively providing excellent retention of electrical cable 104. Spring clip 234 may be assembled to base portion 204 of insulative housing 202 by aligning it with base portion 204 (FIG. 5*a*) and inserting it into base portion 204 from connector end 240 such that bottom portion 236 is positioned adjacent bottom wall 208 of base portion 204 and opposing side portions 238 are positioned adjacent opposing side walls 210 of base portion 204 (FIG. 5*b*). In one embodiment, spring clip 234 is configured to assist in retaining electrical cable 104 prepared as described above with reference to FIGS. 2*a*-2*f*. In this embodiment, spring clip 234 is configured to assist in retaining electrical cable 104 at the portion of conductive tape 136 that is folded forward, sandwiching ground shield 130 and covering an end portion of insulative jacket 132 (FIGS. 2*e*-2*f*). A significant advantage of cable organizer 200 including spring clip 234 is that in addition to assisting in retaining electrical cable 104, in one embodiment, spring clip 234 also makes electrical contact with ground shield 130 of electrical cable 104 (via conductive tape 136) when cable organizer 200 is assembled to terminated electrical connector 100, which provides full electrical grounding of terminated electrical connector 100. Spring clip 234 may also serve as a spacer, which allows cable organizer 200 to be used with a variety of electrical cables 104 having different shapes and sizes. In this case, spring clip 234 compensates for the difference in shape and/or size between electrical cable 104 and channel 228 of cable organizer 200, such that cable organizer 200 still properly retains electrical cable 104. Spring clip 234 may be used in grounded and non-grounded configurations of terminated electrical connector 100.

Figure 6A:
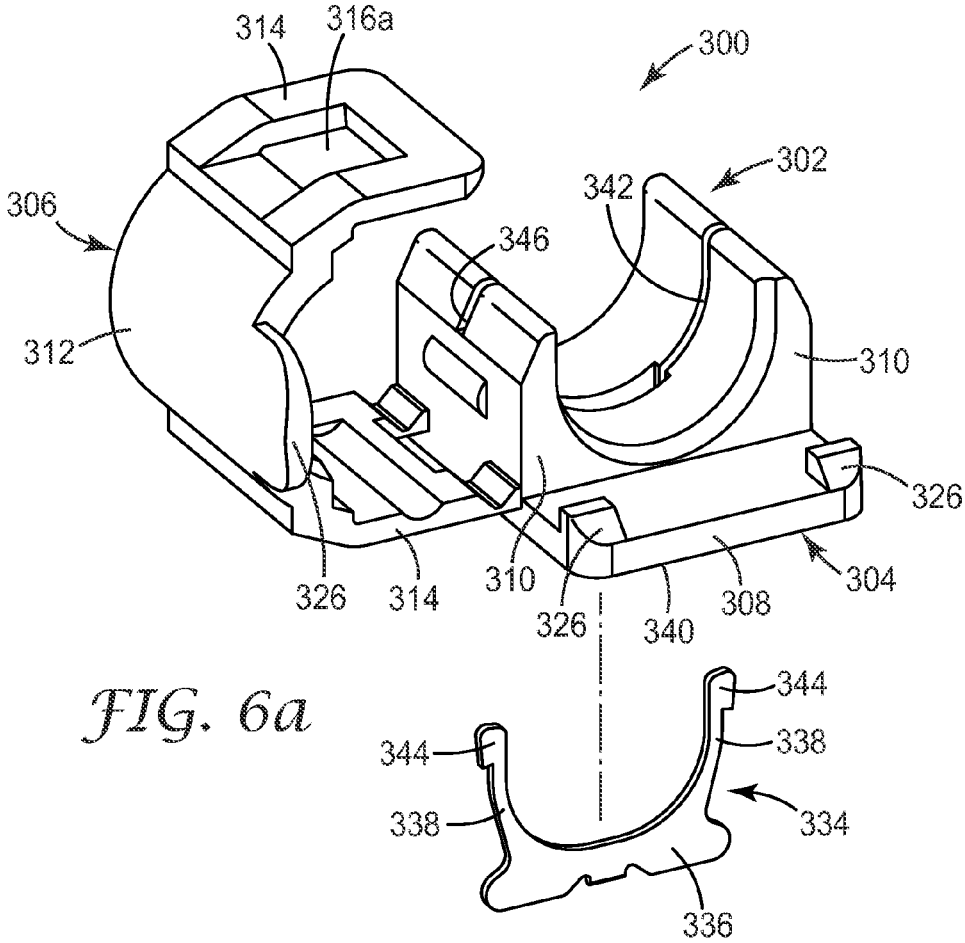
FIG. 6*a* is an exploded top perspective view of another exemplary embodiment of a cable organizer according to an aspect of the present invention in an open position.
Figure 6B:
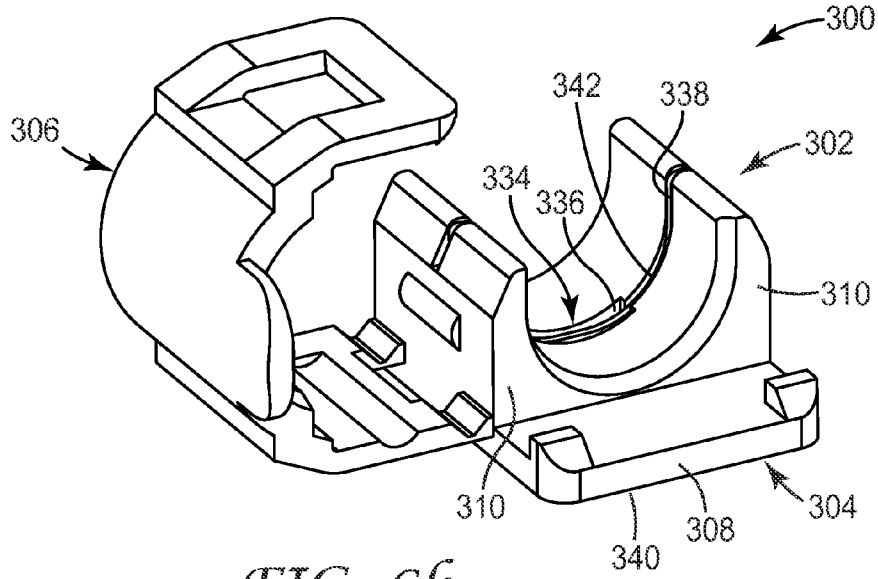
FIG. 6*b* is a top perspective view of the cable organizer of FIG. 6*a* in an open position.
Figure 6C:
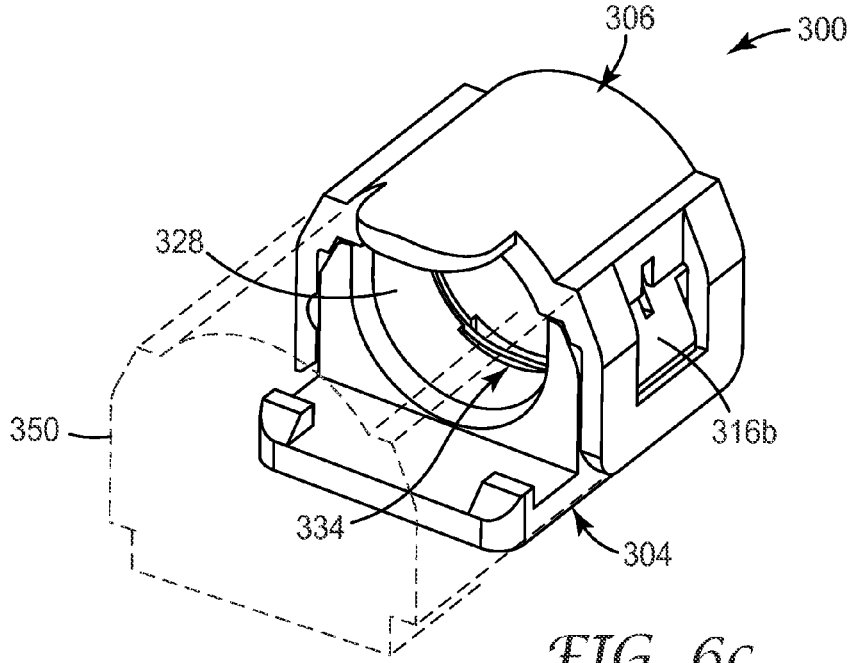
FIG. 6*c* is a top perspective view of the cable organizer of FIG. 6*a* in a closed position.

FIGS. 6*a*-6*c* illustrate another exemplary embodiment of a cable organizer according to an aspect of the present invention. Cable organizer 300 includes a monolithic insulative housing 302 including a base portion 304 and a cover portion 306 hingedly secured to and extending from base portion 304. Base portion 304 includes a bottom wall 308 and opposing first side walls 310 extending from bottom wall 308. Cover portion 306 includes a top wall 312 and opposing second side walls 314 extending from top wall 312. In the embodiment illustrated in FIGS. 6*a*-6*c*, cover portion 306 is hingedly secured to and extends from base portion 304 at one of first and second side walls 310 and 314. The opposing first and second side walls 310 and 314 include corresponding latch members 316*a* and 316*b* configured to cooperatively retain cable organizer 300 in a closed position (FIG. 6*c*). Cable organizer 300 further includes opposing retention elements 326 extending from bottom wall 308 and top wall 312 respectively.

Bottom wall 308, top wall 312, and first side walls 310 cooperatively define a channel 328 configured to retain electrical cable 104 when cable organizer 300 is assembled to terminated electrical connector 100. The size and shape of channel 328 may be selected based on the size and shape of electrical cable 104 and the appropriate retention force as suitable for the intended application.

In the embodiment illustrated in FIGS. 6*a*-6*c*, cable organizer 300 optionally includes a spring clip 334 disposed in channel 328 and configured to assist in retaining electrical cable 104. Spring clip 334 includes a bottom portion 336 and opposing side portions 338 extending from bottom portion 336. Bottom portion 336 is shaped to correspond to bottom wall 308 of base portion 304 and opposing side portions 338 are shaped to correspond to opposing side walls 310 of base portion 304 such that it can resiliently deflect to receive electrical cable 104. In the embodiment illustrated in FIGS. 6*a*-6*c*, spring clip 334 has a U-shape, and side portions 338 are configured to resiliently deflect outward. Spring clip 334 may be assembled to base portion 304 of insulative housing 302 by aligning it with base portion 304 (FIG. 6*a*) and inserting it from bottom end 340 into a clip receiving channel 342 in base portion 304 such that bottom portion 336 is positioned adjacent bottom wall 308 of base portion 304 and opposing side portions 338 are positioned adjacent opposing side walls 310 of base portion 304 (FIG. 6*b*). During the insertion of spring clip 334, side portions 338 may deflect inward and spring back to their original state when spring clip 334 is fully inserted. Spring clip 334 includes hook portions 344 positioned on the ends of side portions 338 and configured to cooperate with a corresponding edge 346 of clip receiving channel 342 to retain spring clip 334 in base portion 304.

In one aspect, cable organizer 300 may be suitable for smaller size electrical cables, whereas cable organizer 200 may be suitable for larger size electrical cables.

Depending on the intended application, the cable organizer according to an aspect of the present invention may have a profile that substantially corresponds to at least one of a profile of the electrical cable and a profile of the electrical connector. For example, cable organizer 200 has a profile 250 (see FIG. 5*c*) that substantially corresponds to a profile 150 of electrical connector 102 (see FIG. 4*a*), and cable organizer 300 has a profile 350 (see FIG. 6*c*) that substantially corresponds to a profile 152 of electrical cable 104 (see FIG. 1*b*). Having substantially corresponding profiles optimizes the amount of space occupied by the assembly of the terminated electrical connector and the cable organizer, and gives the assembly of the terminated electrical connector and the cable organizer an integrated appearance.

In each of the embodiments and implementations described herein, the various components of the electrical connector and elements thereof are formed of any suitable material. The materials are selected depending upon the intended application and may include both metals and non-metals (e.g., any one or combination of non-conductive materials including but not limited to polymers, glass, and ceramics). In one embodiment, electrically insulative components, such as, e.g., body 106, conductor mounting part 110, insulative housing 202, and insulative housing 302, are formed of a polymeric material by methods such as injection molding, extrusion, casting, machining, and the like, while electrically conductive components, such as, e.g., terminals 108, spring clip 234, and spring clip 334, are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A cable organizer for use with an electrical connector terminated to an electrical cable, the cable organizer comprising:

a monolithic insulative housing including a base portion and a cover portion hingedly secured to and extending from the base portion, the base portion including a bottom wall and opposing first side walls extending from the bottom wall, the cover portion including a top wall and opposing second side walls extending from the top wall, wherein the bottom wall, top wall, and first side walls cooperatively define a channel configured to retain the electrical cable when the cable organizer is assembled to the terminated electrical connector, the cable organizer further comprising a spring clip disposed in the channel and configured to assist in retaining the electrical cable.

2. The cable organizer of claim 1, wherein the cover portion is hingedly secured to and extends from the base portion at one of the first and second side walls, and wherein the opposing first and second side walls include corresponding latch members configured to cooperatively retain the cable organizer in a closed position.

3. The cable organizer of claim 1, wherein the cable organizer includes opposing retention elements extending from the bottom wall and the top wall respectively and configured to retain the cable organizer and the electrical connector in a fixed relative position.

4. The cable organizer of claim 1, wherein the cable organizer has a profile that substantially corresponds to at least one of a profile of the electrical cable and a profile of the electrical connector.

5. The cable organizer of claim 1, wherein the opposing first side walls each include a first grip element extending into the channel and configured to assist in retaining the electrical cable.

6. The cable organizer of claim 1, wherein the top wall includes a second grip element extending into the channel and configured to assist in retaining the electrical cable.

7. The cable organizer of claim 1, wherein the spring clip makes electrical contact with a ground shield of the electrical cable when the cable organizer is assembled to the terminated electrical connector.

8. The cable organizer of claim 1, wherein the spring clip includes a bottom portion and opposing side portions extending from the bottom portion, and wherein the bottom portion is shaped to correspond to the bottom wall and the opposing side portions are shaped to correspond to the opposing side walls.

9. The cable organizer of claim 1, wherein the spring clip is adapted to be inserted into a clip receiving channel in the base portion.

10. An electrical connector assembly comprising:

an electrical connector terminated to an electrical cable having a plurality of conductors; and a cable organizer assembled to the terminated electrical connector and comprising:

a monolithic insulative housing including a base portion and a cover portion hingedly secured to and extending from the base portion, the base portion including a bottom wall and opposing first side walls extending from the bottom wall, the cover portion including a top wall and opposing second side walls extending from the top wall, wherein the bottom wall, top wall, and first side walls cooperatively define a channel configured to retain the electrical cable, the cable organizer further comprising a spring clip disposed in the channel and configured to assist in retaining the electrical cable.

11. The electrical connector assembly of claim 10, wherein the electrical connector includes a body, a plurality of terminals disposed in the body and electrically connected to the electrical cable, and a wire mounting part.

12. The electrical connector assembly of claim 10, wherein the electrical connector and the cable organizer include corresponding retention elements configured to cooperatively retain the cable organizer and the electrical connector in a fixed relative position.

* * * * *